US005762083A

United States Patent [19]

Bate

[11] Patent Number: 5,762,083

[45] Date of Patent: Jun. 9, 1998

[54] SUPPORT FOR GARBAGE CHUTE CLEANING APPARATUS

[75] Inventor: Douglas Edward Bate, Edmonton, Canada

[73] Assignee: Skyscraper Cleaning Services Inc., Edmonton, Canada

[21] Appl. No.: 716,619

[22] Filed: Sep. 19, 1996

[51] Int. Cl.[6] ..... B08B 3/02

[52] U.S. Cl. ..... 134/167 C; 134/172; 134/201; 134/181; 254/273

[58] Field of Search ..... 134/167 C, 167 R, 134/172, 181, 201; 239/273, 264, 265, 722; 254/323, 325, 326, 327

[56] References Cited

U.S. PATENT DOCUMENTS

| | | | |
|---|---|---|---|
| 1,776,100 | 9/1930 | Blatt | 239/265 |
| 2,276,990 | 3/1942 | Long | 254/325 |
| 3,578,290 | 5/1971 | Gof | 254/290 |
| 3,744,719 | 7/1973 | Wallick | 239/722 |
| 4,050,587 | 9/1977 | Moen | 254/325 |
| 4,068,827 | 1/1978 | Fanning et al. | 254/325 |
| 4,071,919 | 2/1978 | Fields et al. | 15/21 R |
| 4,107,001 | 8/1978 | Kinzler | 134/167 C |
| 4,220,170 | 9/1980 | Hebert et al. | 134/167 R |
| 5,020,183 | 6/1991 | Grant, Jr. | 134/167 R |

FOREIGN PATENT DOCUMENTS

| | | | |
|---|---|---|---|
| WO80/02656 | 12/1980 | WIPO | B08B 1/04 |

*Primary Examiner*—Frankie L. Stinson
*Attorney, Agent, or Firm*—Anthony R. Lambert

[57] ABSTRACT

A support for a garbage chute cleaning apparatus includes a cart having ground engaging wheels. Outrigger legs are provided for anchoring and providing lateral stability to the cart. A rotatably mounted reel is provided having a length of line mounted on the cart. Two telescopically extendible vertical support columns are mounted on the cart. A telescopically extendible horizontal cross-beam extends between the two vertical support columns. The horizontal cross-beam has a remote end with a line guide which receives line from the rotatably mounted reel. A Counterweight is mounted to the cart opposite the remote end of the horizontal cross-beam. This provides a counterbalance to a garbage chute cleaning apparatus supported from the line at the remote end of the horizontal cross-beam.

12 Claims, 5 Drawing Sheets

SUPPORT FOR GARBAGE CHUTE CLEANING APPARATUS

FIELD OF THE INVENTION

The present invention relates to a support for a garbage chute cleaning apparatus.

BACKGROUND OF THE INVENTION

It is common for residential highrise buildings to have a garbage chute. In recent years it has come to be recognized that microorganisms growing on walls of the garbage chute present a potential health risk. To address this problem, garbage chute cleaning apparatus have been developed. U.S. Pat. No. 4,071,919 which issued to Fields et al in 1978 is one such garbage chute cleaning apparatus. The Fields et al reference discloses a wheeled cart that holds a length of hose. At a remote end of the length of hose a spray nozzle is mounted. The spray nozzle is lowered by means of the hose down a garbage chute. The wheeled cart has a tank to hold fluid and a pump, by means of which pressurized fluid is supplied to the spray nozzle at the end of the length of hose. Garbage chute cleaning apparatus, as disclosed by Fields et al, with self contained tank and pump are no longer used. The amount of water such a tank could hold did not come close to approaching the volume of water supplied. Similarly, the amount of pressure that could be generated by the size of pump that could be carried on a cart was inadequate. These problems are now addressed through the use of a truck or trailer mounted pressure pump which is attached to the water service for the highrise building. The hose is introduced from below and pulled up the garbage chute to the top of the building. A support is still required from which the garbage chute cleaning apparatus may be suspended.

With the apparatus described in the Fields et al reference access is obtained to the garbage chute through one of the user access doors used by residents to dump refuse into the garbage chute. Normally the user access door selected is on the top floor of the residential highrise. This unavoidably causes disruption to the residents of the residential highrise. It is preferable, wherever possible, to access the garbage chute from the roof. In most cases, however, no provision has been made during the construction of the residential highrise for an access opening expressly for the purpose of cleaning. All garbage chutes, however, have a roof vent. There is absolutely no standardization in the positioning of the roof vents in terms of their height, size or orientation (vertical, horizontal or angular). There is also a wide variance as to the clearance space provided in the vicinity of the vent. The positioning of the roof top access openings and vents vary so widely that most apparatus for cleaning garbage chutes are only capable of cleaning a small percentage of residential highrise buildings. The problem of finding suitable equipment is exacerbated by the fact that the equipment must be compact enough to travel up in the elevator as it is not practical to carry the equipment up 20 or more flights of stairs. In addition, the equipment must be light, as elevators generally do not travel to roof level, so carrying the equipment from the top floor onto the roof is unavoidable.

SUMMARY OF THE INVENTION

What is required is a support for a garbage chute cleaning apparatus that is versatile enough to meet the needs of most, if not all, garbage chute access situations.

According to the present invention there is provided a support for a garbage chute cleaning apparatus including a cart having ground engaging wheels. Means are provided for anchoring and providing lateral stability to the cart. A rotatably mounted reel is provided having a length of line mounted on the cart. Two telescopically extendible vertical support columns are mounted on the cart. A telescopically extendible horizontal cross-beam extends between the two vertical support columns. The horizontal cross-beam has a remote end with a line guide which receives line from the rotatably mounted reel. Counterweight means is mounted to the cart opposite the remote end of the horizontal cross-beam. This provides a counterbalance to a garbage chute cleaning apparatus supported from the line at the remote end of the horizontal cross-beam.

The support, as described above, can be telescopically retracted into a sufficiently compact form that it fits into an elevator. Once on the roof of the residential highrise building, it is telescopically extendible both vertically and horizontally to reach over obstacles. The cart can take a number of forms. The preferred form of cart, however, has a first end and a second end. The first end is supported by two spaced apart ground engaging wheels. The second end is supported by a ground engaging member. A handle is provided at the first end. By pulling upon the handle the cart is pivoted about the ground engaging wheels to lift the ground engaging member off a ground surface.

Although beneficial results may be obtained through the use of the support, as described above, some means is required for anchoring and providing lateral stability to the cart. Even more beneficial results may, therefore, be obtained when the cart has height adjustable outrigger legs. Preferably, the lateral spacing between the outrigger legs is adjustable in order to provide a wider and more stable stance.

Although beneficial results may be obtained through the use of the support, as described above, it is preferable that the support be made as light as possible to minimize the amount of weight which must be carried both in the elevator and up the stair to the roof. One of the heaviest items is the counterweight used to counterbalance the weight of the garbage chute cleaning apparatus. Even more beneficial results may, therefore, be obtained when the counterweight means is a liquid tight ballast tank. The ballast tank can be carried to the roof empty and then filled water by means of a garden hose.

Although beneficial results may be obtained through the use of the support, as described above, in order to obtain the maximum benefits of the counterweight principles of leverage should be employed. Even more beneficial results may, therefore, be obtained when the liquid tight ballast tank is telescopically mounted for movement toward and away from the remote end of the horizontal cross-beam.

Although beneficial results may be obtained through the use of the support, as described above, the further the horizontal cross-beam is telescopically extended the greater the changes that the cart will tip under the weight of the garbage chute cleaning apparatus. Even more beneficial results may, therefore, be obtained when the lateral spacing between the telescopically extendible vertical support columns is adjustable.

Although beneficial results may be obtained through the use of the support, as described above, the adjustments required are so numerous that the cart can become unduly complex. Even more beneficial results may, therefore, be obtained when the cart is equipped with a first horizontal support beam which is laterally extendible in a first direction and a second horizontal support beam which is laterally extendible in a second direction. The first horizontal support beam supports a first height adjustable outrigger leg and one of the two telescopically adjustable vertical support columns. The second horizontal support beam supports a second height adjustable outrigger leg and the counterweight.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
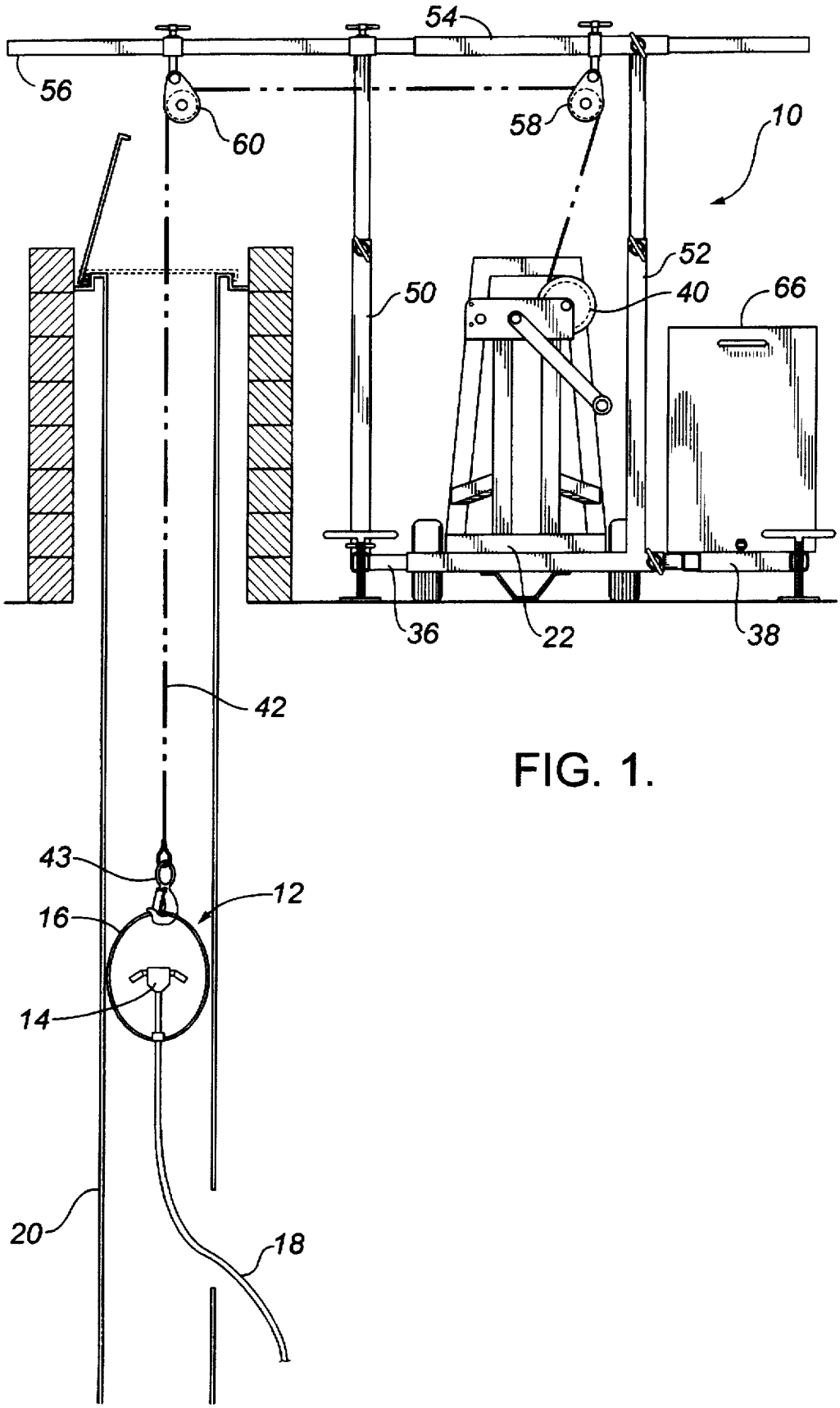
FIG. 1 is a rear elevation view of a support for a garbage chute cleaning apparatus constructed in accordance with the teachings of the present invention, with a garbage chute cleaning apparatus suspended from the support.

The preferred embodiment, a support for a garbage chute cleaning apparatus generally identified by reference numeral 10, will now be described with reference to FIGS. 1 through 6.

Referring to FIG. 1, there is illustrated a preferred form of garbage chute cleaning apparatus, generally identified by reference numeral 12. Garbage chute cleaning apparatus 12 includes a spray head 14, a spray head guard 16, and a length of hose 18. Garbage chute cleaning apparatus 12 is shown positioned within a garbage chute 20. Length of hose 18 extends down garbage chute 20 and is connected to a large truck or trailer mounted pumping unit (not shown) that is supplied with water from the water service for the residential highrise building.

Figure 2:
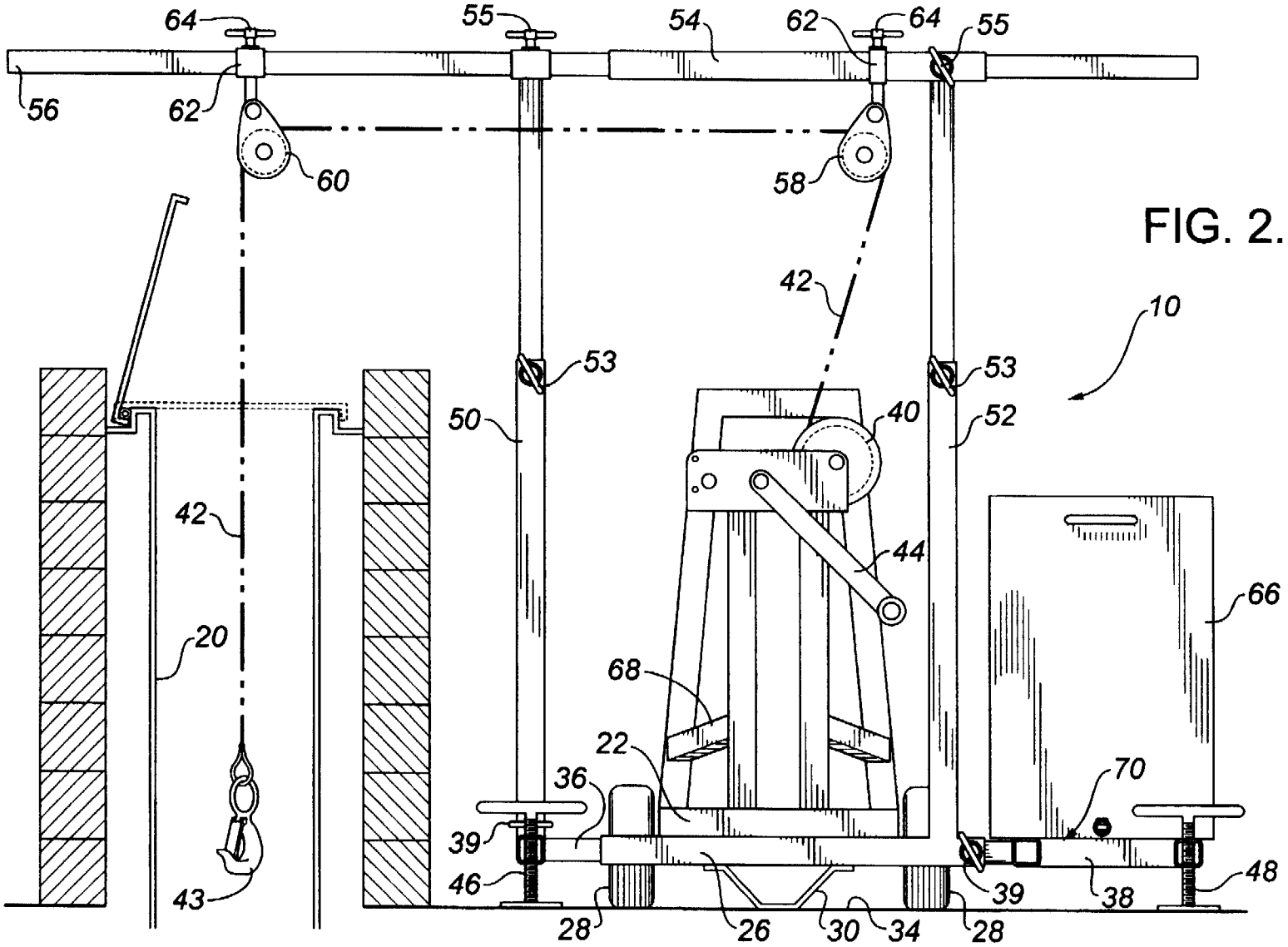
FIG. 2 is a rear elevation view of the support illustrated in FIG. 1, showing access through a horizontal access opening.
Figure 3:
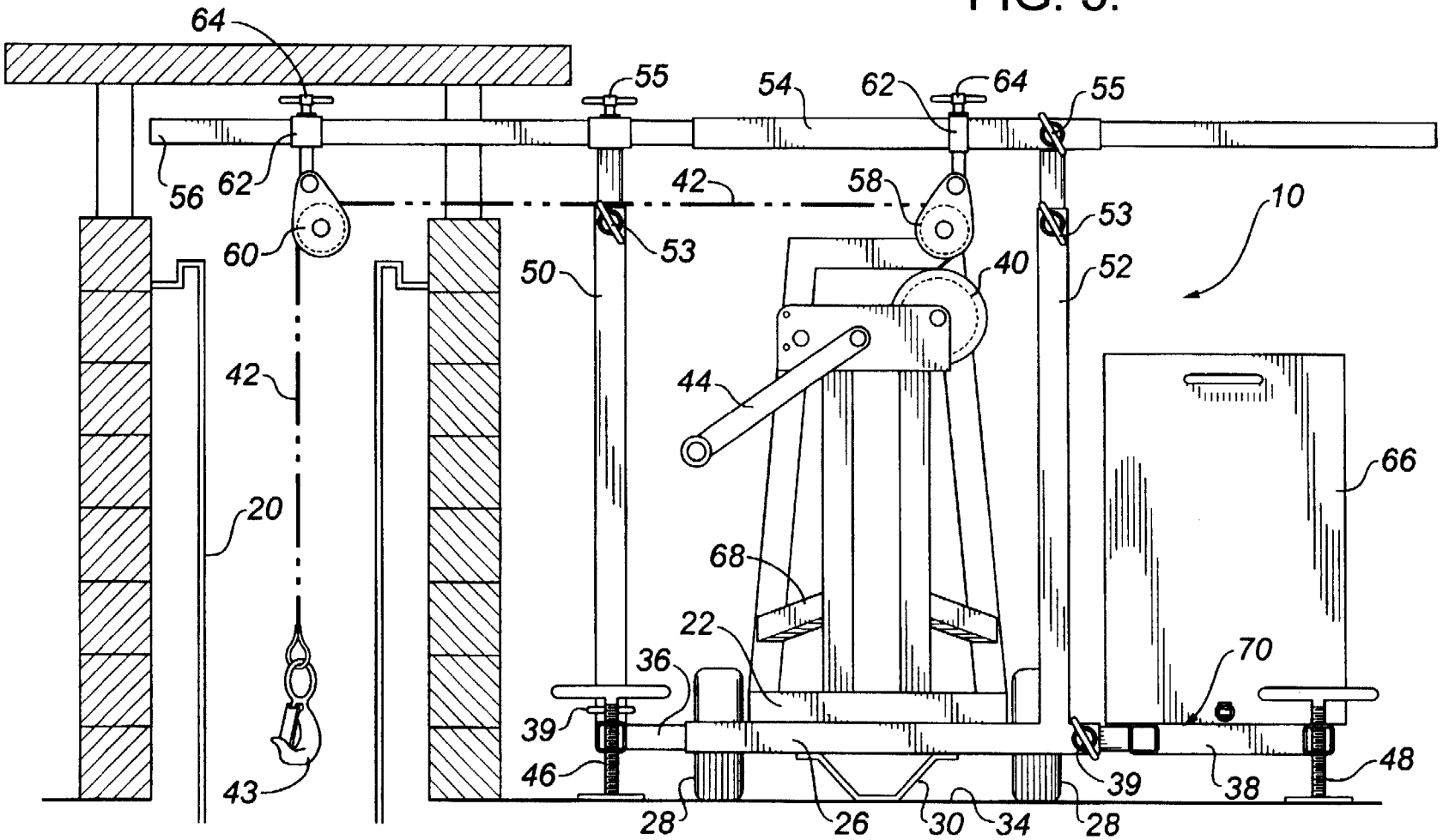
FIG. 3 is a rear elevation view of the support illustrated in FIG. 1, showing access through a vertical vent opening.
Figure 4:
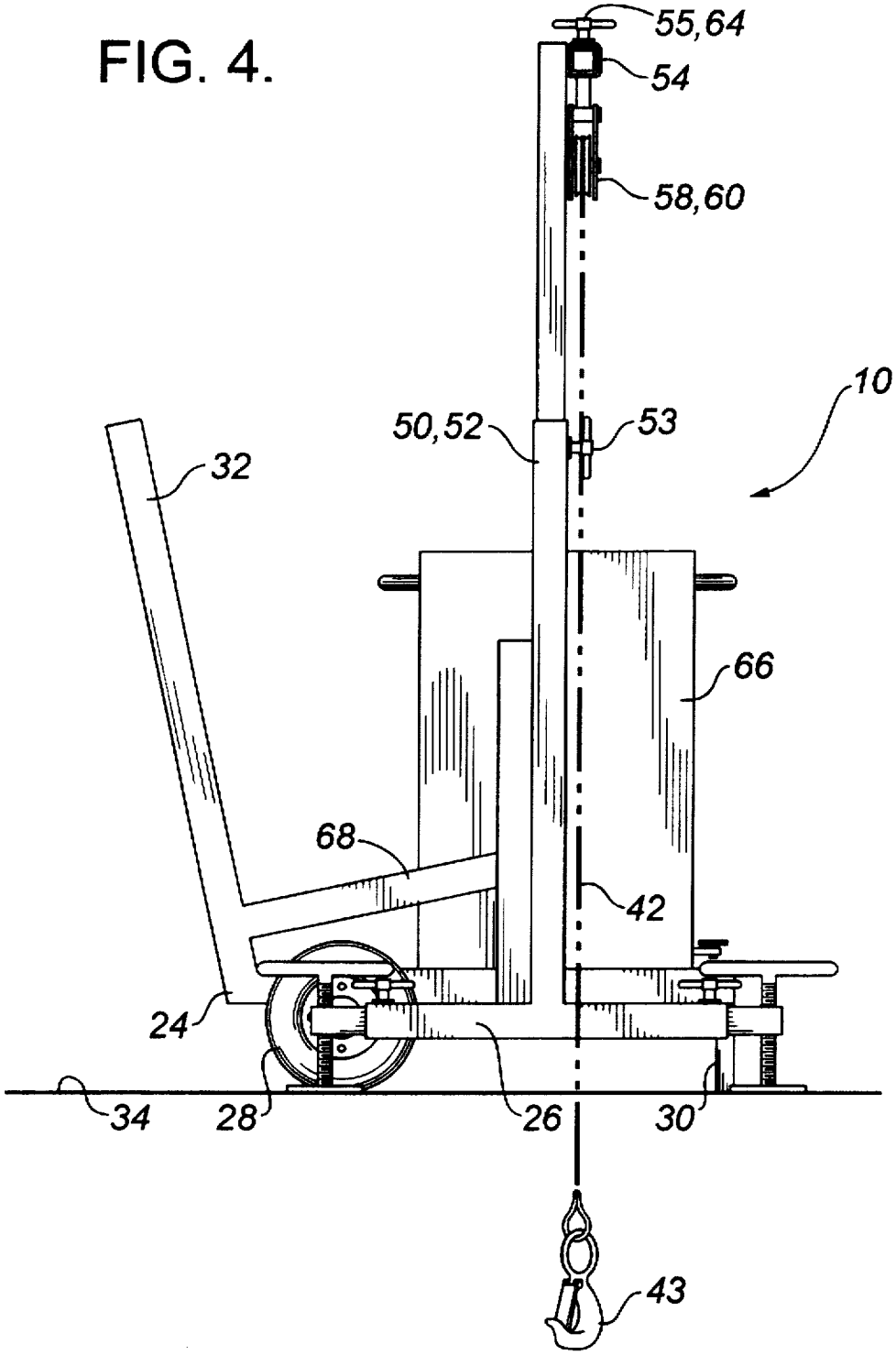
FIG. 4 is a right side elevation view of the support illustrated in FIG. 1, with outriggers deployed.
Figure 5:
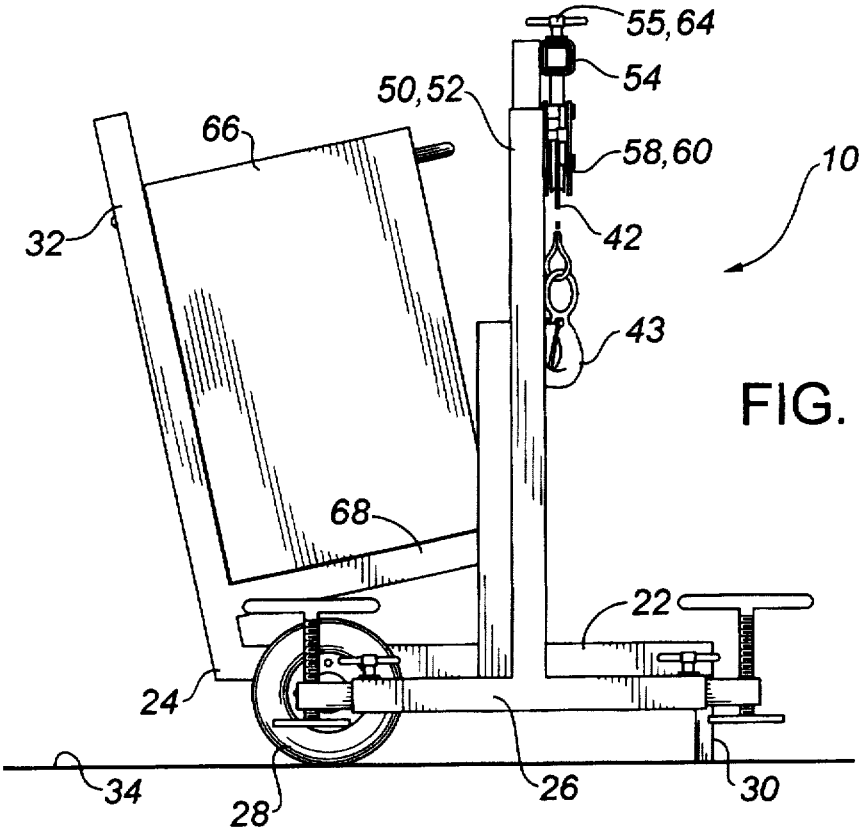
FIG. 5 is a right side elevation view of the support illustrated in FIG. 1, with outriggers raised.
Figure 6:
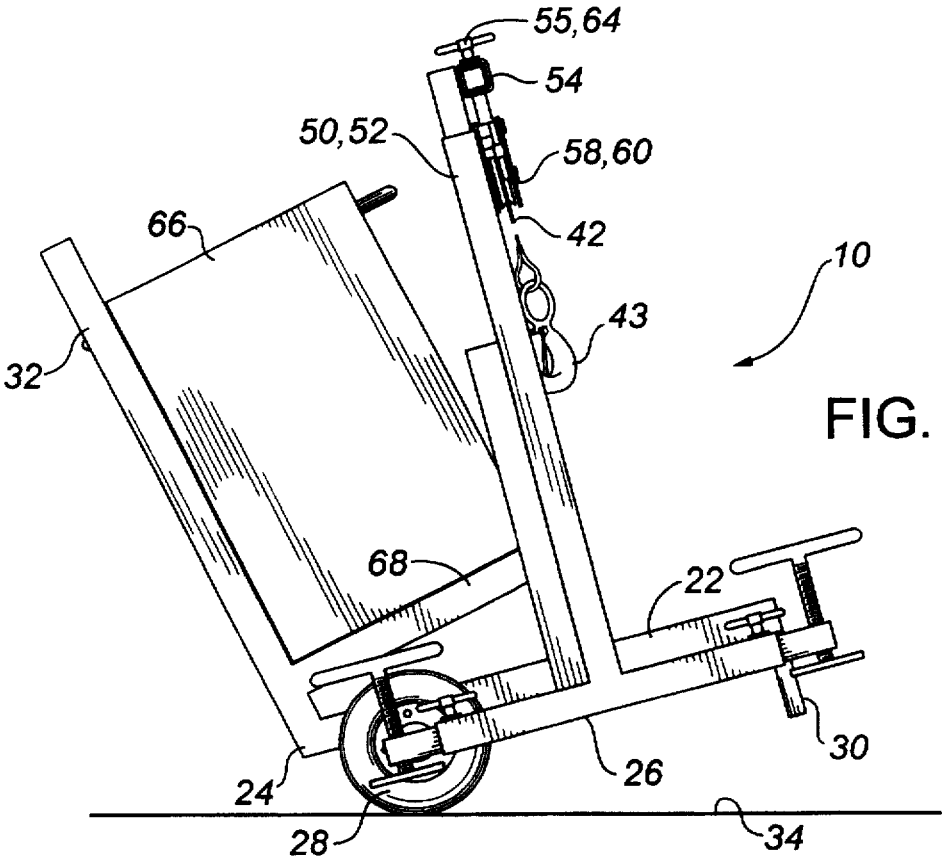
FIG. 6 is a right side elevation view of the support illustrated in FIG. 5, in a transport position.

Referring to FIGS. 4 through 6, support 10 includes a cart 22 having a first or front end 24 and a second or rear end 26. Referring to FIGS. 1 through 3, first end 24 is supported by two spaced apart ground engaging wheels 28. Referring to FIGS. 4 through 6, the second end is supported by a ground engaging member 30. A handle 32 is provided at first end 24. By pulling upon handle 32, cart 22 can be pivoted about ground engaging wheels 28 from a resting position illustrated in FIG. 5, to a transport position illustrated in FIG. 6, with ground engaging member 30 lifted off a supporting ground surface 34. Referring to FIGS. 2 and 3, a first horizontal support beam 36 is provided which is laterally telescopically extendible from cart 22 in a first direction. A second horizontal support beam 38 is provided which is laterally telescopically extendible from cart 22 in a second direction. Second direction is substantially opposed to first direction. First horizontal support beam 36 and second horizontal support beam 38 are locked in a selected telescopic position by screw clamps 39. A rotatably mounted reel 40 is mounted on cart 22. Reel 40 supports a length of line 42. Line 42 is wound on and off of reel 40 by means of a crank 44. A first screw-form height adjustable outrigger leg 46 is positioned on first horizontal support beam 36. A second screw-form height adjustable outrigger leg 48 is positioned on second horizontal support beam 38. A first telescopically extendible vertical support column 50 is mounted on first horizontal support beam 36. A second telescopically extendible vertical support beam 52 is mounted on cart 22. Vertical support beams 50 and 52 are each locked in a desired telescopic position by screw clamps 53. A telescopically extendible horizontal cross-beam 54 extends between first vertical support column 50 and second vertical support column 52. Horizontal cross-beam 54 is locked in a desired telescopic position by a screw clamp 55. Horizontal cross-beam 54 has a remote end 56 extending in the first direction. Two line guides 58 and 60 are positioned along horizontal cross-beam 54. Line guides 58 and 60 receive line 42 from reel 40. Line guides 58 and 60 are mounted to collars 62 than slide along horizontal cross-beam 54. Each of collars 62 has a screw-form clamping mechanism 64, by means of which the collars 62 may be fixed at a desired position along horizontal cross-beam 54. A liquid tight ballast tank 66 is provided that has two mounting positions. Referring to FIGS. 5 and 6, there is illustrated a support frame 68 mounted on cart 22 which provides a transport position. Referring to FIGS. 2 and 3, there is illustrated a support frame 70 secured to second horizontal support beam 38 which provides an operative or counterbalance position. When ballast tank 66 is in the operative position, it provides a counterbalance when garbage chute cleaning apparatus 12 is supported from line 42 at remote end 56 of horizontal cross-beam 54.

The use and operation of support 12 will now be described with reference to FIGS. 1 through 6. Support 12 collapses down to a relatively compact transport position illustrated in FIG. 5. It can be moved merely by pulling upon handle 32 to pivot cart 22 can be pivoted about ground engaging wheels 28 from a resting position illustrated in FIG. 5, to a transport position illustrated in FIG. 6. In the transport position ballast tank 66 rests upon support frame 68. Referring to FIG. 6, when cart 22 is pivoted all the weight is transferred onto wheels 28 as ground engaging member 30 is lifted off supporting ground surface 34. Referring to FIGS. 2 and 3, once support 12 is on the roof of the residential highrise building, it is deployed. The advantage that support 12 provides is that it can be adapted to virtually any access situation; two such access situations are illustrated. First horizontal support beam 36 is telescopically extended laterally from cart 22 in the first direction and locked in position with screw clamp 39. This movement also moves laterally first screw-form height adjustable outrigger leg 46 and first telescopically extendible vertical support column 50. Second horizontal support beam 38 then telescopically extended laterally from cart 22 in the second direction and locked in position with screw clamp 39. Ballast tank 66 is then placed onto support frame 70 on second horizontal support beam 38 in the operative or counterbalance position. First vertical support column 50 and second vertical support column 52 are then telescopically extended to the desired height and locked in position by screw clamps 53. Horizontal cross-beam 54 is then telescopically extended to a desired position, and locked in position by screw clamp 55. Collars 62 from which line guides 58 and 60 depend then slid along horizontal cross-beam 54 and clamped in position by screw-form clamping mechanisms 64. Prior to use ballast tank 66 is filled with water, to provide the necessary counterbalance weight. Line 42 is then fed from reel 40 and coupled by a hook 43 to spray head guard 16 of garbage chute cleaning apparatus 12, garbage chute cleaning apparatus 12 can then be raised and lowered in garbage chute 20, as required to complete the cleaning operation.

The versatility of support 12 will be apparent to one skilled in the art. It will also be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A support for a garbage chute cleaning apparatus, comprising:

a cart having ground engaging wheels;

means for anchoring and providing lateral stability to the cart;

a rotatably mounted reel having a length of line mounted on the cart;

two telescopically extendible vertical support columns mounted on the cart;

a telescopically extendible horizontal cross-beam extending between the two vertical support columns, the horizontal cross-beam having a remote end with a line guide which receives line from the rotatably mounted reel; and counterweight means mounted to the cart opposite the remote end of the horizontal cross-beam, thereby providing a counterbalance to garbage chute cleaning apparatus supported by the line, the counterweight means having a transport position and a counterbalance position.

2. The support for a garbage chute cleaning apparatus as defined in claim 1, wherein the means for anchoring and providing lateral stability to the cart are height adjustable outrigger legs.

3. The support for a garbage chute cleaning apparatus as defined in claim 2, wherein the lateral spacing between the outrigger legs is adjustable.

4. The support for a garbage chute cleaning apparatus as defined in claim 1, wherein the counterweight means is a ballast tank.

5. The support for a garbage chute cleaning apparatus as defined in claim 4, wherein the ballast tank is telescopically mounted for movement toward and away from the remote end of the horizontal cross-beam.

6. The support for a garbage chute cleaning apparatus as defined in claim 1, wherein the lateral spacing between the two telescopically extendible vertical support columns is adjustable.

7. The support for a garbage chute cleaning apparatus as defined in claim 1, wherein the cart has a first end and a second end, the first end being supported by two spaced apart ground engaging wheels, the second end being supported by a ground engaging member, a handle being provided at the first end, such that by pulling upon the handle the cart is pivoted about the ground engaging wheels to lift the ground engaging member off a ground surface.

8. The support for a garbage chute cleaning apparatus as defined in claim 1, wherein the rotatably mounted reel is crank activated.

9. The support for a garbage chute cleaning apparatus as defined in claim 1, wherein the cart has a first horizontal support beam which is laterally extendible in a first direction and a second horizontal support beam which is laterally extendible in a second direction, the first horizontal support beam supporting a first height adjustable outrigger leg and one of the two telescopically adjustable vertical support columns, the second horizontal support beam supporting a second height adjustable outrigger leg and the counterweight means.

10. A support for a garbage chute cleaning apparatus, comprising:

a cart having a first end and a second end, the first end being supported by two spaced apart ground engaging wheels, the second end being supported by a ground engaging member, a handle being provided at the first end, such that by pulling upon the handle the cart is pivoted about the ground engaging wheels to lift the ground engaging member off a ground surface;

a first horizontal support beam which is laterally extendible from the cart in a first direction;

a second horizontal support beam which is laterally extendible from the cart in a second direction, substantially opposed to the first direction;

a rotatably mounted reel having a length of line mounted on the cart;

a first height adjustable outrigger leg on the first horizontal support beam;

a second height adjustable outrigger leg on the second horizontal support beam;

a first telescopically extendible vertical support column mounted on the first horizontal support beam a second telescopically extendible vertical support beam mounted on the cart;

a telescopically extendible horizontal cross-beam extending between the first vertical support column and the second vertical support column, the horizontal cross-beam having a remote end extending in the first direction, a line guide which receives line from the rotatably mounted reel is positionable in a selected position along the horizontal cross-beam; and a liquid tight ballast tank mounted to the second horizontal support beam, thereby providing a counterbalance to a garbage chute cleaning apparatus supported from the line at the remote end of the horizontal cross-beam.

11. The support for a garbage chute cleaning apparatus as defined in claim 10, wherein the ballast tank has a transport position and a counterbalance position.

12. The support for a garbage chute cleaning apparatus as defined in claim 10, wherein the rotatably mounted reel is crank activated.

* * * * *